US011486587B2

(12) United States Patent
Karunanidhi et al.

(10) Patent No.: US 11,486,587 B2
(45) Date of Patent: Nov. 1, 2022

(54) MULTI-ZONE FLEXI-POSITIONING AIR-CONDITIONING SYSTEM

(71) Applicant: L&T TECHNOLOGY SERVICES LIMITED, Chennai (IN)

(72) Inventors: Murlidharan Karunanidhi, Chennai (IN); Senthilkumar Chandrasekaran, Chennai (IN); Suresh Kodisana, Chennai (IN); Aravind Subramanian, Madurai (IN)

(73) Assignee: L&T TECHNOLOGY SERVICES LIMITED, Chennai (IN)

( * ) Notice: Subject to any disclaimer, the term of this patent is extended or adjusted under 35 U.S.C. 154(b) by 114 days.

(21) Appl. No.: 16/765,923

(22) PCT Filed: Nov. 23, 2018

(86) PCT No.: PCT/IB2018/059247

§ 371 (c)(1),
(2) Date: May 21, 2020

(87) PCT Pub. No.: WO2019/102404

PCT Pub. Date: May 31, 2019

(65) Prior Publication Data

US 2020/0355374 A1 Nov. 12, 2020

(30) Foreign Application Priority Data

Nov. 23, 2017 (IN) ..... 201741042048

(51) Int. Cl.
*F24F 1/0043* (2019.01)
*F24F 11/62* (2018.01)
(Continued)

(52) U.S. Cl.
CPC ..... *F24F 1/0043* (2019.02); *F24F 1/0047* (2019.02); *F24F 1/0063* (2019.02);
(Continued)

(58) Field of Classification Search
CPC ... F16C 37/007; F24F 1/0047; F24F 2221/14; F24F 2110/30; F24F 2110/10;
(Continued)

(56) References Cited

U.S. PATENT DOCUMENTS 6,606,875 B1 * 8/2003 Grand ..... B60H 1/00014 62/239
9,152,191 B1 * 10/2015 Gardner ..... G06F 1/20
(Continued)

*Primary Examiner* — Schyler S Sanks
(74) *Attorney, Agent, or Firm* — Kendal Sheets

(57) ABSTRACT

An HVAC system is disclosed. The HVAC system includes at least one heat exchanger unit disposed within a predefined area. The HVAC system further includes at least one frame cooperating with each of the at least one heat exchanger unit. The at least one frame includes a guiding assembly configured to move each of the at least one heat exchanger unit across the predefined area. The guiding assembly includes a guiding rail. The guiding assembly further includes at least one slider cooperating with the guiding rail to enable movement of the at least one heat exchanger unit. Each of the at least one slider comprises a fastening unit configured to attach a heat exchanger unit to an associated slider. The guiding assembly includes at least one actuator, wherein each of the at least one actuator is configured to move an associated slider from the at least one slider.

20 Claims, 7 Drawing Sheets

(51) Int. Cl.

| | |
|---|---|
| ***F24F 1/0068*** | (2019.01) |
| ***F24F 1/0047*** | (2019.01) |
| ***F24F 1/0063*** | (2019.01) |
| ***F24F 140/50*** | (2018.01) |
| ***F24F 110/30*** | (2018.01) |
| ***F24F 110/10*** | (2018.01) |

(52) U.S. Cl.
CPC ..... *F24F 1/0068* (2019.02); *F24F 11/62* (2018.01); *F24F 2110/10* (2018.01); *F24F 2110/30* (2018.01); *F24F 2140/50* (2018.01); *F24F 2221/14* (2013.01)

(58) Field of Classification Search
CPC ..... F24F 2140/50; F24F 11/62; F24F 1/0063; F24F 1/0068; F24F 1/0043; F24D 19/0243; F24D 19/0216; A47B 2088/4235
See application file for complete search history.

(56) References Cited

U.S. PATENT DOCUMENTS

| | | | | |
|---|---|---|---|---|
| 2010/0070089 | A1* | 3/2010 | Harrod | G05B 19/042 700/277 |
| 2014/0265792 | A1* | 9/2014 | Chiu | A47B 88/57 312/334.44 |
| 2016/0305679 | A1* | 10/2016 | Noguchi | F24F 11/89 |
| 2016/0327298 | A1* | 11/2016 | Sinha | F24F 11/30 |
| 2017/0082334 | A1* | 3/2017 | Kawagoe | F25B 1/00 |

* cited by examiner

MULTI-ZONE FLEXI-POSITIONING AIR-CONDITIONING SYSTEM

TECHNICAL FIELD

This disclosure relates generally to a Heating, Ventilation, and Air Conditioning (HVAC) systems and, more particularly relates to an HVAC system equipped with modular heat exchanger units supported by a guiding rail assembly.

BACKGROUND

Split and multi-split air conditioning systems are conventional systems for controlling temperature in residential and commercial areas. The split air conditioning is a one-to-one system that includes one indoor heat exchanger unit connected to an external refrigeration unit. The indoor heat exchanger unit absorbs heat from the surrounding air, while the external refrigeration unit transfers the heat to the environment. A multi-type air conditioning system operates on the same principles as the split type air conditioning system, however in the former case, there are multiple indoor heat exchanger unit that are connected to a single external refrigeration unit. This is also applicable for the reverse flow, i.e., indoor heat exchanger units acting as heat pumps.

A Variable Refrigerant Flow (VRF) is a large-scale version of ductless mini-split air conditioning system. A conventional VRF system includes a single external refrigeration unit and multiple indoor heat exchanger units. The external refrigeration unit typically includes a compressor and a condenser, while the indoor heat exchanger units includes an expansion valve and a fan. The VRF system controls the amount of refrigerant fluid flowing to the multiple indoor heat exchanger units, enabling the use of many indoor heat exchanger units of differing capacities and configurations connected to a single external refrigeration unit. Such arrangement provides an individualized comfort control, and simultaneous heating and cooling in different zones.

However, as indoor heat exchanger units are fixed at respective locations, the above-mentioned systems suffer from the restricted movement of the indoor heat exchanger units. This results in uneven temperature within a confined region as well as limited and inefficient usage of indoor heat exchanger units.

SUMMARY

In one embodiment, a Heating, Ventilation, and Air Conditioning (HVAC) system is disclosed. The HVAC system includes at least one heat exchanger unit disposed within a predefined area. The HVAC system further includes at least one frame cooperating with each of the at least one heat exchanger unit. The at least one frame includes a guiding assembly configured to move each of the at least one heat exchanger unit across the predefined area. The guiding assembly includes a guiding rail enabling movement of the one or more heat exchanger units along the length of one or more of the at least one frame. The guiding assembly further includes at least one slider cooperating with the guiding rail to enable movement of the at least one heat exchanger unit, wherein each of the at least one slider comprises a fastening unit configured to attach a heat exchanger unit from the at least one heat exchanger unit to an associated slider from the at least one slider. The guiding assembly includes at least one actuator, wherein each of the at least one actuator is configured to move an associated slider from the at least one slider.

In yet another embodiment, a frame for an HVAC system is disclosed. The frame includes a guiding assembly configured to move each of the at least one heat exchanger unit across the predefined area. The guiding assembly includes a guiding rail enabling movement of the one or more heat exchanger units along the length of one or more of the at least one frame. The guiding assembly further includes at least one slider cooperating with the guiding rail to enable movement of the at least one heat exchanger unit, wherein each of the at least one slider comprises a fastening unit configured to attach a heat exchanger unit from the at least one heat exchanger unit to an associated slider from the at least one slider. The guiding assembly includes at least one actuator, wherein each of the at least one actuator is configured to move an associated slider from the at least one slider.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Exemplary embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the following detailed description be considered as exemplary only, with the true scope and spirit being indicated by the following claims.

Figure 1:
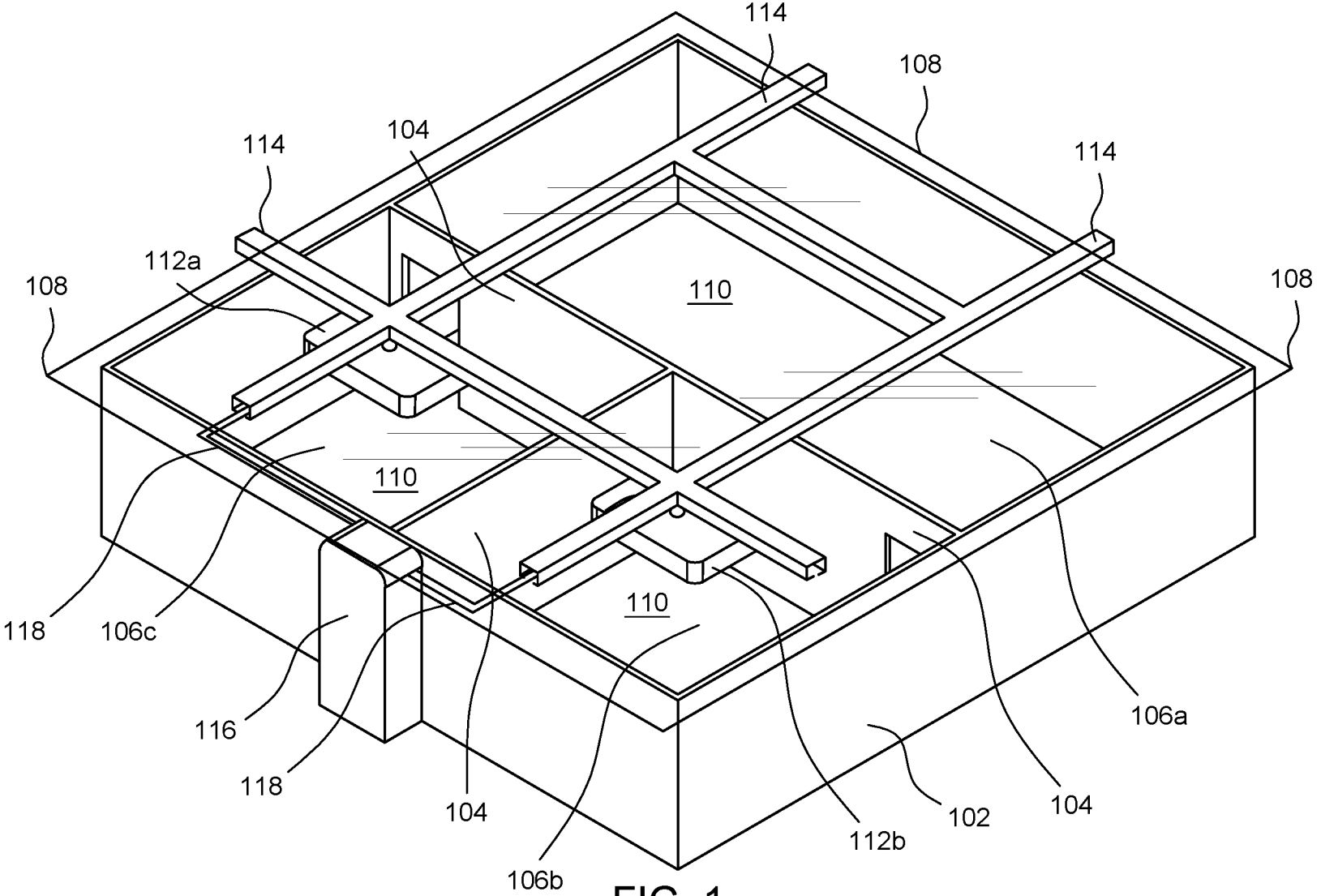
FIG. 1 illustrates an isometric view of a Heating, Ventilation, and Air Conditioning (HVAC) system in a predefined area 102, in accordance with some embodiments

Referring now to FIG. 1, an isometric view 100 of a Heating, Ventilation, and Air Conditioning (HVAC) system in a predefined area 102 is illustrated, in accordance with some embodiments. The HVAC system may be employed or installed within the predefined area 102 in order to control and manage one or more of heating, ventilation, and air conditioning within the predefined area 102. The predefined area 102 may be an enclosed area that may further include one or more partitions 104, which divide the predefined area 102 into a sub-area 106*a*, a sub-area 106*b*, and a sub-area 106*c*, collectively referred to as, a plurality of sub-areas 106. Each of the plurality of sub-areas 106 may also be an enclosed area. In other words, the current temperature may be different within each of the plurality of sub-areas 106, owing to different dimensions and occupancy level. It will be apparent to a person skilled in the art that the predefined area 102 may not include the one or more partitions 104, or in other words, the predefined area 102 may be a bare shell that does not include any sub-area.

The one or more partitions 104 may be temporary or permanent walls. The one or more partitions 104 may be connected to each other side to side, thereby forming the plurality of sub-areas 106. The predefined area 102 may further include a ceiling 108 on the top of the one or more partitions 104 and a floor 110 at the bottom of the one or more partitions 104. In an embodiment, the one or more partitions 104 may be connected to both the ceiling 108 and the floor 110. Alternatively, the one or more partitions 104 may be offset from one of the ceiling 108 and the floor 110. Examples of the predefined area 102 may thus include, but are not limited to a room, a container, a chamber, a hall, or an auditorium. It would further be apparent to a person skilled in the art that the predefined area may be an open area.

The HVAC system may include one or more heat exchanger units 112 (for example, a heat exchanger unit 112*a* and a heat exchanger unit 112*b*), which may move independently of each other. In an embodiment, when the HVAC system is employed to cool the predefined area 102, the one or more heat exchanger units 112 act as condenser or gas cooler to reduce the temperature of the predefined area 102. Alternatively, when the HVAC system is employed to heat the predefined area 102, the one or more heat exchanger units 112 act as heat pumps to increase the temperature of the predefined area 102. The one or more heat exchanger units 112 act as heat pumps, when refrigerant flow in the HVAC system is in a direction that is opposite to the direction of refrigerant flow in case of cooling.

The HVAC system further includes a frame 114. It will be apparent to a person skilled in the art that a single frame 114 is depicted for ease of description, and the HVAC system may include multiple such frames. The frame 114 may cooperate with the one or more heat exchanger units 112, in order to facilitate movement of the one or more heat exchanger units 112 across the predefined area 102. This may enable selective placement of the one or more heat exchanger units 112 across the plurality of sub-areas 106, as each of the one or more heat exchanger units 112 can move independently of each other. By way of an example, the frame 114 may facilitate movement and subsequent placement of the heat exchanger units 112*a* within the sub-area 106*c* and placement of the heat exchanger units 112*b* within the sub-area 106*b*. In order to facilitate movement of each of the one or more heat exchanger units 112 amongst the plurality of sub-areas 106, each of the one or more partitions 104 may have an opening having dimensions that allow easy passage of a heat exchanger unit from one sub-area to the other.

The frame 114 may be affixed to the ceiling 108, may be placed in proximity to the ceiling 108, or may be placed on an independent structure, which is not attached to the ceiling 108 or any wall of the predefined area 102. Thus, in this case, the one or more heat exchanger units 112 may move parallel to the ceiling 108 and the floor 110. Alternatively, the frame 114 may be affixed to one or more walls of the predefined area. Thus, in this case, each of the one or more heat exchanger units 112 may move parallel to one or more walls. As a result, movement of the one or more heat exchanger units 112 within the predefined area 102 may be multi-directional. Various components of the frame 114 are depicted and described in detail in conjunction with FIG. 2, FIG. 3, and FIG. 4.

The HVAC system further includes a refrigeration unit 116 that may be mounted external to the predefined area 102. In an embodiment, the refrigeration unit 116 may be mounted on an external wall of the predefined area 102. Alternatively, the refrigeration unit 116 may be placed on the floor or the ground outside the predefined area 102. The refrigeration unit 116 may be connected to the one or more of heat exchanger units 112 through one or more conduits 118 that are placed in a closed refrigerant flow circuit (not shown in FIG. 1). The closed refrigerant flow circuit may either be concealed within the frame 114 or may be externally attached to the frame 114. In other words, the frame 114 may support the closed refrigerant flow circuit.

The one or more conduits 118 may facilitate flow of a refrigerant between the refrigeration unit 116 and the one or more heat exchanger units 112. Each of the one or more conduits 118 thus act as refrigerant lines, each of which may be a hose. The hose may be one or more of a flexible hose, an extendible hose, or a stretchable hose. Examples of the material of the hose may include, but are not limited to nylon, synthetic, or other flexible material.

In order to facilitate movement of the one or more heat exchanger units 112 while being attached to the one or more conduits 118, the HVAC system may include one or more winding arrangements (not shown in FIG. 1). A winding arrangement is configured to wrap a conduit that is attached to one of the one or more heat exchanger units 112, when that heat exchanger unit moves towards the refrigeration unit 116. Additionally, the winding arrangement is configured to unwrap the conduit, when that heat exchanger unit moves away from the refrigeration unit 116 to a desired position within the predefined area 102. In an embodiment, each of the one or more winding arrangements may be placed within the refrigeration unit 116. Thus, the refrigeration unit 116 may include multiple winding arrangements. Alternatively, the one or more winding arrangements may be placed outside the refrigeration unit 116, but in close proximity to the refrigeration unit 116. In another embodiment, each of the one or more heat exchanger units 112 may include one of the one or more winding arrangements. Alternatively, a winding arrangement may be externally attached to each of the one or more heat exchanger units 112.

Figure 2:
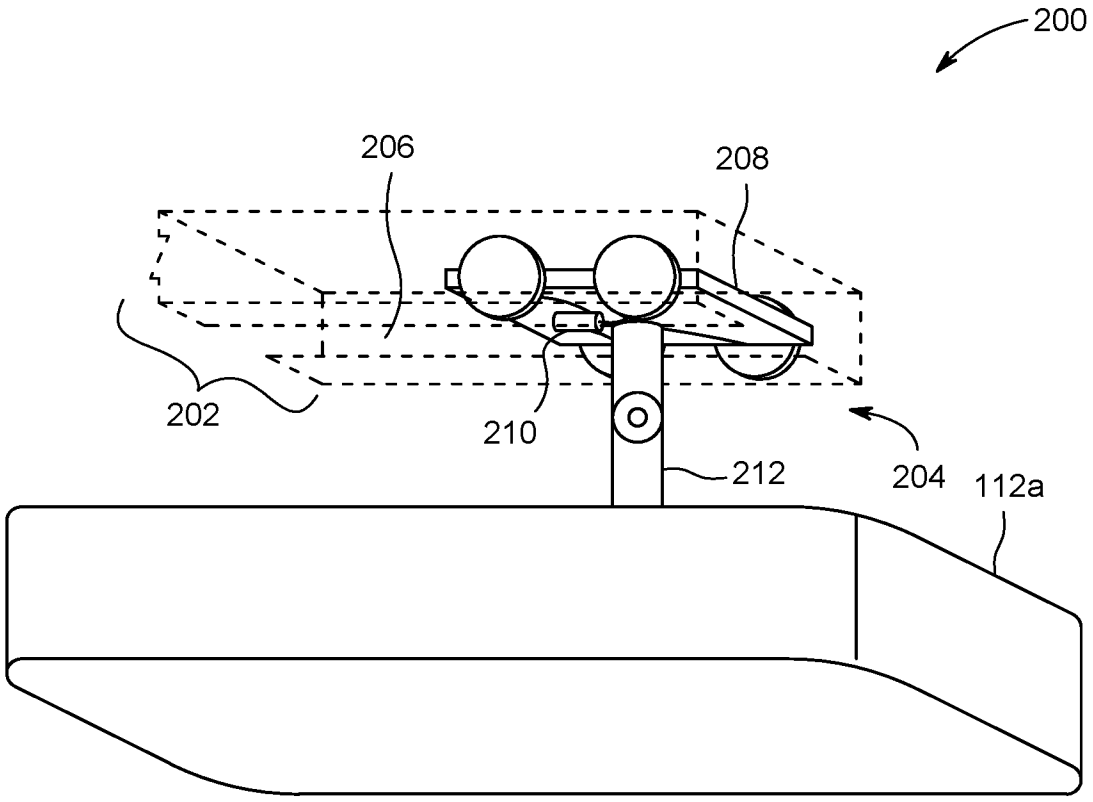
FIG. 2 illustrates an isometric view of a section of a frame in an HVAC system, in accordance with some embodiments

Referring now to FIG. 2, an isometric view 200 of a section 202 of the frame 114, is illustrated in accordance with some embodiments. The frame 114 may include a guiding assembly 204 that is configured to move each of the one or more heat exchanger units 112 across the predefined area 102. The guiding assembly 204 may include a guiding rail 206, a slider 208, and an actuator 210. In FIG. 2, a single slider 208 and a single actuator 210 have been depicted for ease of explanation. It will be apparent to a person skilled in the art that that the guiding assembly may include multiple such sliders and actuators. Additionally, description of the slider 208 and the actuator 210 are applicable to each of the multiple sliders and actuators respectively.

The guiding rail 206 facilitates movement of the one or more heat exchanger units 112 along the length of the frame 114. The guiding rail 206 may be formed within the frame 114. In an embodiment, C-type profile of the guiding rail 206 may be used. Alternatively, S-type profile, H-type profile, or other existing profiled may also be used. etc. In an embodiment, the guiding rail 206 may be separately attached to the frame 114 by using an attaching means. The attaching means for example, may include, but are not limited to welding, bolts, screws, epoxy glue, or rivets. In an embodiment, the guiding rail 206 may be independently attached directly to one or more walls of the predefined area 102 or the ceiling 108, without the frame 114.

The slider 208 may cooperate with the guiding rail 206 to enable movement of the heat exchanger unit 112*a*. The slider 208 includes one or more wheels that may engage with rails of the guiding rail 206, to enable movement of the slider 208 over the guiding rail 206. In an embodiment, the wheels may be replaced by ball bearings or any other mechanism that enables movement of the slider 208 over the guiding rail 206. Additionally, dimension of the slider 208 may be such that, the slider 208, while moving along the guiding rail 206 does not get dislodged from the guiding rail 206.

The slider 208 further includes a fastening unit 212 that is configured to attach the heat exchanger unit 112*a* to the slider 208. In an embodiment, the fastening unit 212, may include two interlocking parts, such that, one of the parts may be affixed to the heat exchanger unit 112*a* and the other part may be affixed to the slider 208. The two interlocking parts may be interlocked in order to attach the heat exchanger unit 112*a* to the slider 208. The heat exchanger unit 112*a* may subsequently be detached from the slider 208, if required, by unlocking the fastening unit 212. This enables fast and efficient removal of existing heat exchanger units and attachment of new heat exchanger units.

Figure 3:
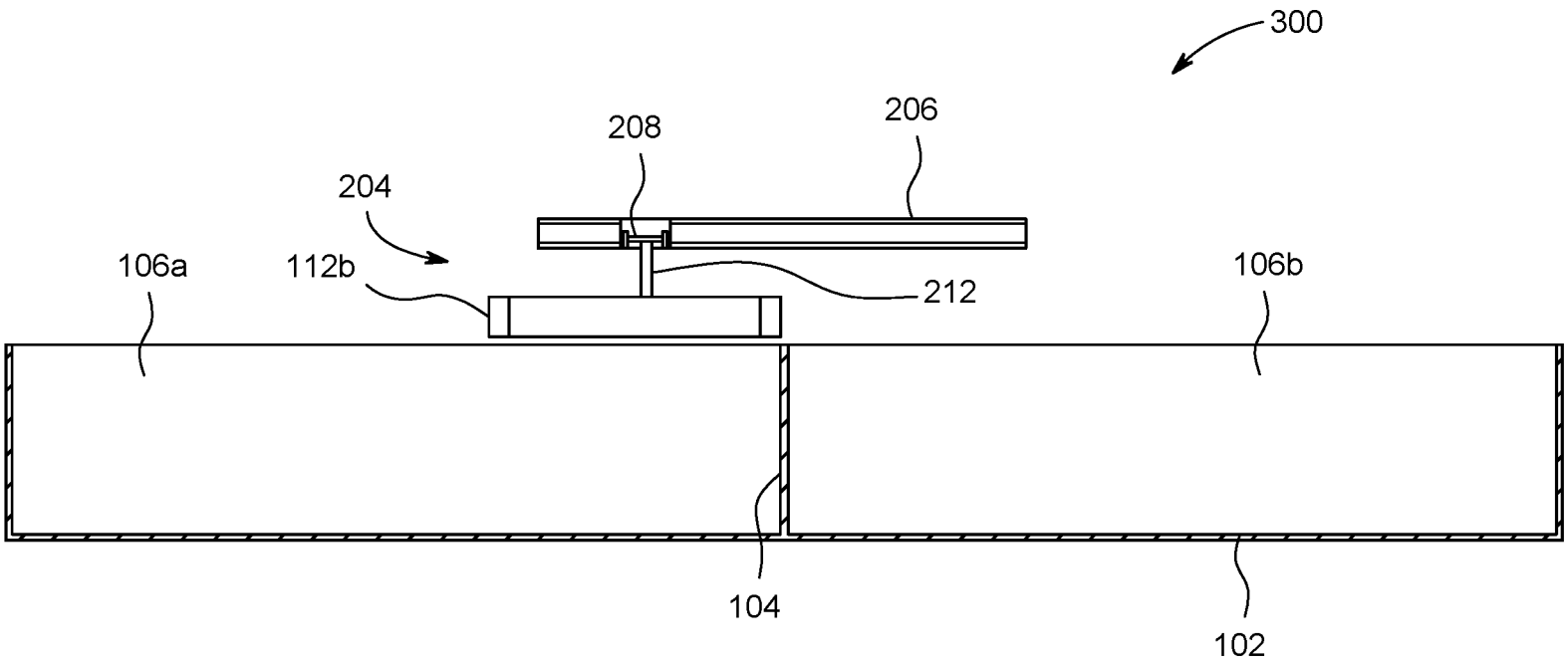
FIG. 3 illustrates a side view of a section of a frame in an HVAC system, in accordance with some embodiments.
Figure 4:
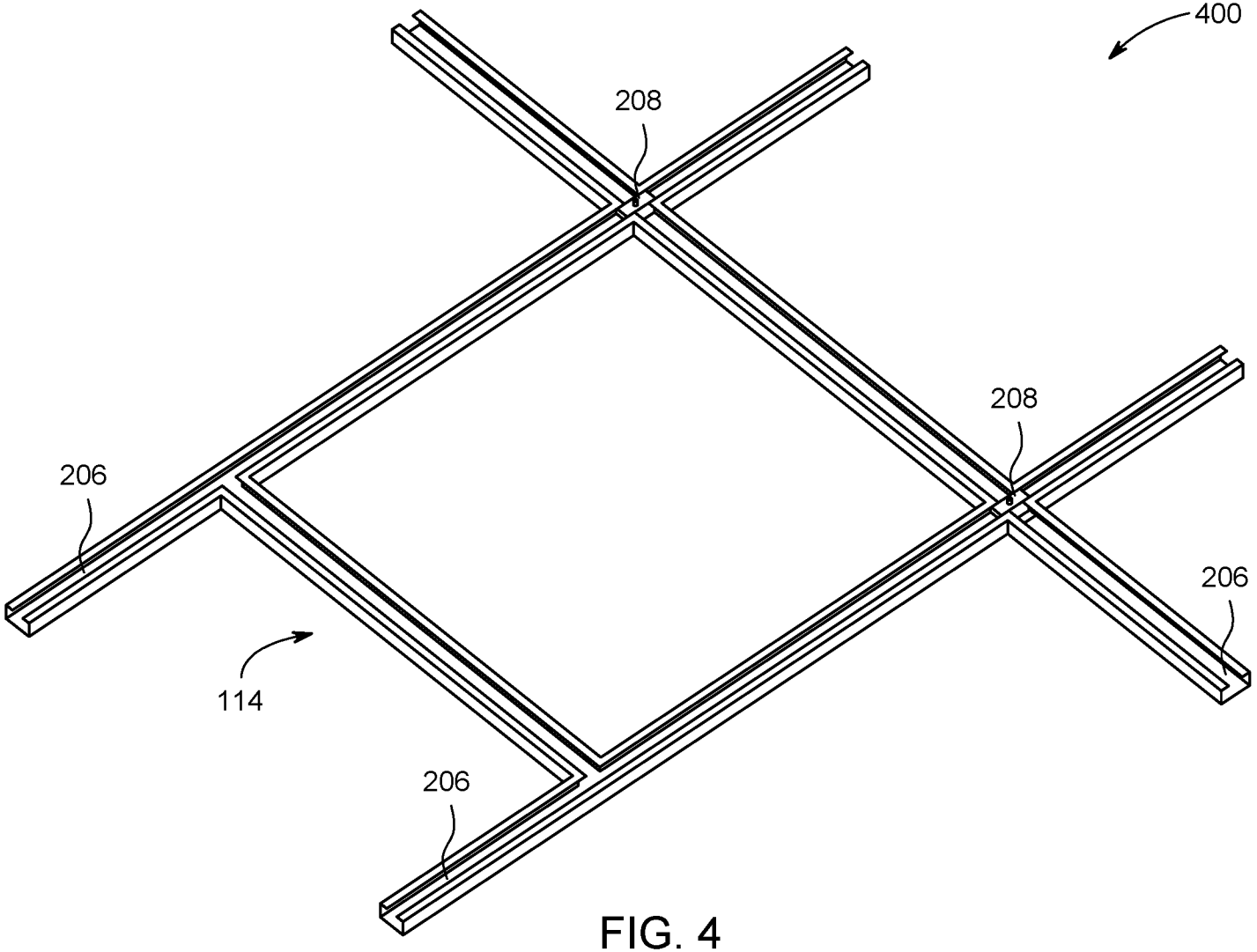
FIG. 4 illustrates an isometric bottom view of a frame that includes a guiding rail and a slider, in accordance with some embodiments.

Movement of the slider 208 is enabled by the actuator 210 either automatically or by manual sliding. The actuator 210 may include, but is not limited to a mechanical actuator, a hydraulic actuator, an electrical actuator, a pneumatic actuator, or a magnetic actuator. Examples of the actuator 210, may include, but are not limited to a motor, a pneumatic piston, or a hydraulic piston. A side view 300 of the section 202 is illustrated in FIG. 3, in accordance with some embodiments. Further, an isometric bottom view 400 of the frame 114 including the guiding rail 206 and the slider 208 is illustrated in FIG. 4, in accordance with some embodiments.

It will be apparent to a person skilled in the art that FIG. 2 is depicted for illustrative purpose and the invention is not limited to the same. Other implementation or variations of the guiding assembly 204 are within the scope of the invention.

Figure 5:
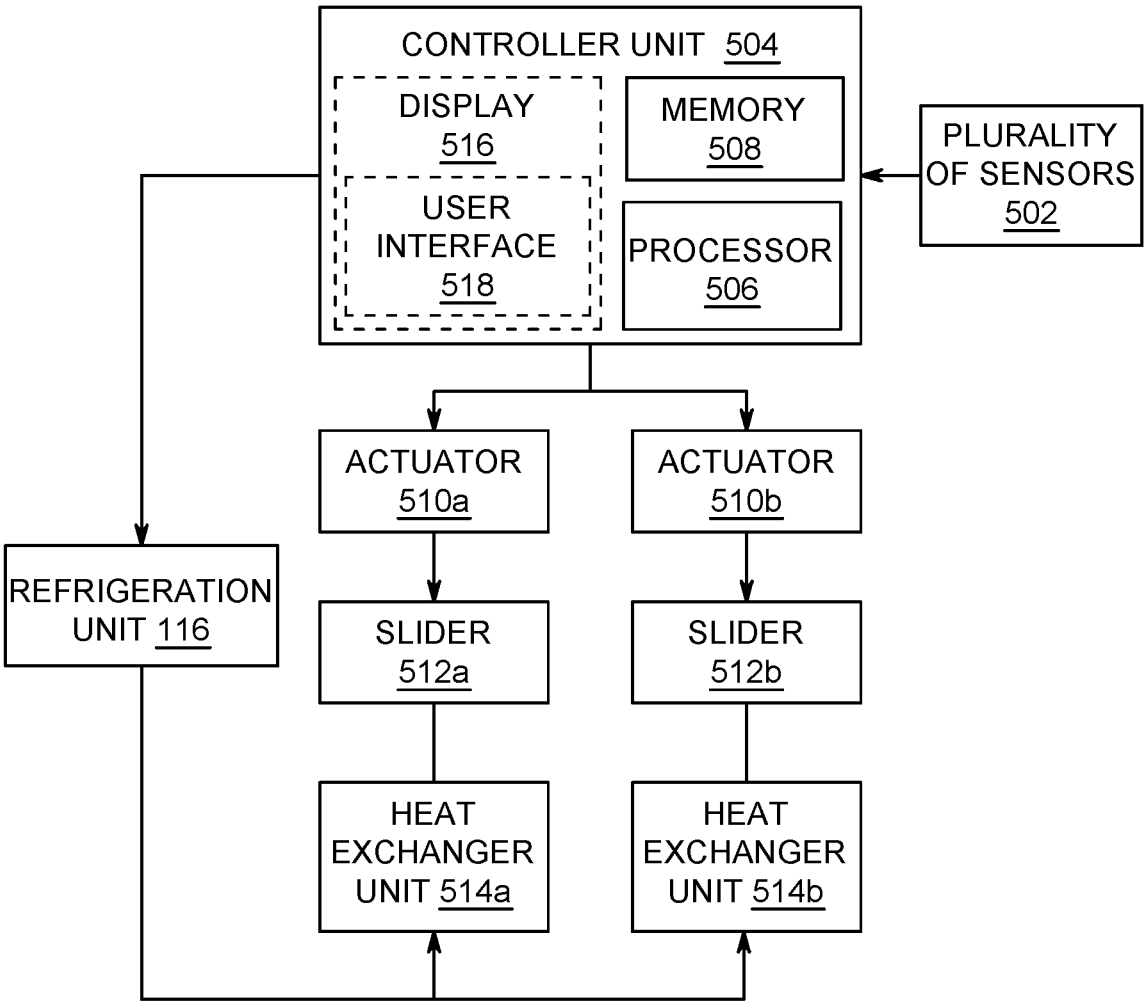
FIG. 5 illustrates a block diagram depicting flow of control information within an HVAC system to enable movement of one or more heat exchanger units within a predefined area, in accordance with some embodiments.

Referring now to FIG. 5, a block diagram 500 depicting flow of control information within the HVAC system to enable movement of the one or more heat exchanger units 112 within the predefined area 102 is illustrated, in accordance with some embodiments. The one or more heat exchanger units 112 are moved from one position to the other within the predefined area 102, based on varying load, space, and flow requirements for each of the plurality of sub-areas 106. In order to capture the load, space, and flow requirements, the HVAC system may include a plurality of sensors 502 that are placed within each of the plurality sub-areas 106. The plurality of sensors 502, for example, may include, but are not limited to temperature sensors, presence sensors, cameras, or infrared sensors. The plurality of sensors 502 may capture data that may include, but is not limited to least one of load data, flow data, space, people density data, or temperature data. By way of an example, a camera may also capture and recognize faces of individuals, in order to provide them customized temperature, based on their current location within the predefined area 102. By way of another example, a camera or an infrared sensor may also be used to determine the number of people within each of the plurality sub-areas 106. More number of people in an enclosed area may imply an increased cooling requirement within that area and less number of people may imply a decreased cooling requirement within that area.

A controller unit 504 within the HVAC system may receive the information captured by the plurality of sensors 502. The controller unit 504 may include a processor 506 and a memory 508. The memory may store processor instructions, which on execution cause the processor 506 to operate the HVAC system. The memory 508 may be a non-volatile memory or a volatile memory. Examples of the non-volatile memory, may include, but are not limited to a flash memory, a Read Only Memory (ROM), a Programmable ROM (PROM), Erasable PROM (EPROM), and Electrically EPROM (EEPROM) memory. Examples of the volatile memory may include, but are not limited Dynamic Random-Access Memory (DRAM), and Static Random-Access memory (SRAM).

The processor 506 analyses the data captured by the plurality of sensors 502 and determines the load, space, and flow requirements at each of the plurality of sub-areas 106. In an embodiment, each of the plurality of sensors 502 may include their location information and/or sensor Identifier (ID) while sharing the captured data. In another embodiment, the memory 508 may store a mapping of sensor IDs of the plurality of sensors 502 and their corresponding location within the predefined area 102. The memory 508 may also store a layout map of the predefined area 102, such that, boundary coordinates of each of the plurality of sub-areas 106 are also stored in the memory 508. Based on the mapping, the processor 506 may identify relevant sensor data and a location within the predefined area 102, for which the relevant sensor data was captured.

Based on the determined location, the processor 506 may activate one or more actuators 510 (for example, an actuator 510*a* and an actuator 510*b*) to move one or more sliders 512 (for example, a slider 512*a* and a slider 512*b*) from a current position to a new position, which corresponds to the determined location, within the predefined area 102. As a result of the movement of the one or more sliders 512, one or more heat exchanger units 514 (for example, a heat exchanger units 514*a* and a heat exchanger units 514*b*) attached to the one or more sliders 512 are moved to the new position. By way of an example, based on the capture sensor data, the processor 506 may determine that the sub-area 106*b* requires cooling. Thereafter, the processor 506, based on the boundary coordinates of the sub-area 106*b* stored in the memory 508, may determine coordinates of a central point in the sub-area 106*b*. The processor 506 may then activate the actuator 510*a* to move, via the slider 512*a*, the heat exchanger unit 514*a* to the determined coordinates.

Further, the processor 506, based on the determined load, space, and flow requirements at the new position, sends instructions to the refrigeration unit 116. Based on these instructions, the refrigeration unit 116 may control the flow of refrigerant fluid to a heat exchanger unit placed at the new position.

The controller unit 504 may further include a display 516 which may be used to display the current operating parameters of the HVAC system, temperature readings at each of the plurality of sub-areas 106, and current location of each of the one or more heat exchanger units 514. The display 516 may include a User Interface (UI) 518, which may be used by an operator to remotely control the movement, load, and flow of each of the one or more heat exchanger units 514. In an embodiment, the control unit 504 may be connected to an external input device, for example, a joystick, a switch, a mobile phone, a computer, or a laptop. In this case, the operator may trigger instructions through the external input device, which are then received by the control unit 504.

In an embodiment, the operator may configure or provide an operating program for the HVAC system to the controller unit 504. The operating program, for example, may define various times at which each of the one or more heat exchanger units 514 should move to a particular location within the predefined area 102 in order to attain a desired temperature. When the operation program is put in action, each of the one or more heat exchanger units 514 move to an instructed location based on the operating program. When the desired temperature is attained at the instructed location, each of the one or more heat exchanger units 514 may move to a subsequent position instructed in the operating program or to their respective original positions. In an embodiment, the memory 508 may store multiple such operating programs and an operator may select one of these operating programs, through the UI 518. The operator, via the UI 518, may also customize an operating program based on specific requirements.

It will be apparent to a person skilled in the art that the one or more actuators 510 are analogous to the actuator 210, the one or more sliders 512 are analogous to the slider 208, and the one or more heat exchangers 514 are analogous to the one or more heat exchangers 112.

Figure 6:
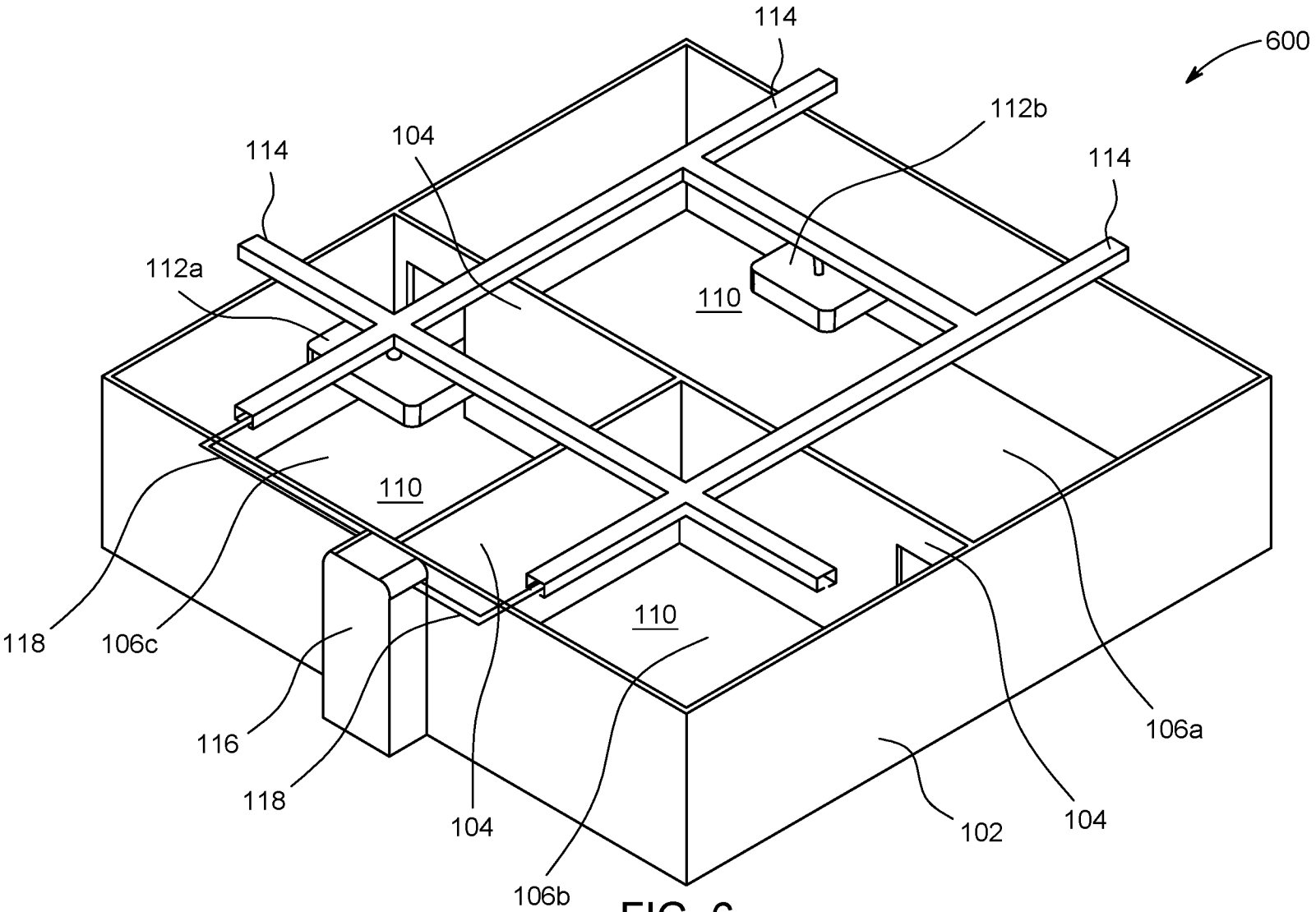
FIG. 6 illustrates an isometric view depicting movement of a heat exchanger unit within a predefined area, in accordance with some embodiments.

Referring now to FIG. 6, an isometric view 600 depicting movement of the heat exchanger unit 112*b* within the predefined area 102 is illustrated, in accordance with some embodiments. Referring back to the FIG. 1, original position of the heat exchanger unit 112*b* is within the sub-area 106*b*. However, based on data captured by one or more of the plurality of sensors 502 placed in the sub-area 106*a*, the controller unit 504 may determine that the sub-area 106*a* requires immediate cooling. This process of determining is already explained in detail in conjunction with FIG. 5.

Accordingly, the processor 506 may send instructions to an actuator to move a slider attached to the heat exchanger unit 112*b* to the sub-area 106*a*. In the instructions, the processor 506 may provide coordinates of a central point of the sub-area 106*a*. In response to the instructions, the actuator may move the heat exchanger unit 112*b* to the central point on the frame 114. Thereafter, the processor 506 may instruct the refrigeration unit 116 to control flow of the refrigerant fluid to the heat exchanger unit 112*b*, in order to attain the desired temperature in the sub-area 106*a*.

In an embodiment, the HVAC system may include a single heat exchanger unit, for example, the heat exchanger unit 112*b* deployed in the predefined area 102, such that, the predefined area 102 includes only two sub-areas, i.e., the sub-area 106*a* and the sub-area 106*b*. In other words, heat exchanger unit 112*b* controls temperature of both the sub-areas 106*a* and 106*b* simultaneously. When temperature in the sub-area 106*a* reaches a desired temperature, the heat exchanger unit 112*b* may slide to the sub-area 106*b*. When the temperature requirement of both the sub-areas 106*a* and 106*b* are met, the heat exchanger unit 112*b* may return to a position, that is central to both the sub-areas 106*a* and 106*b*, thereby providing uniform air conditioning.

Figure 7:
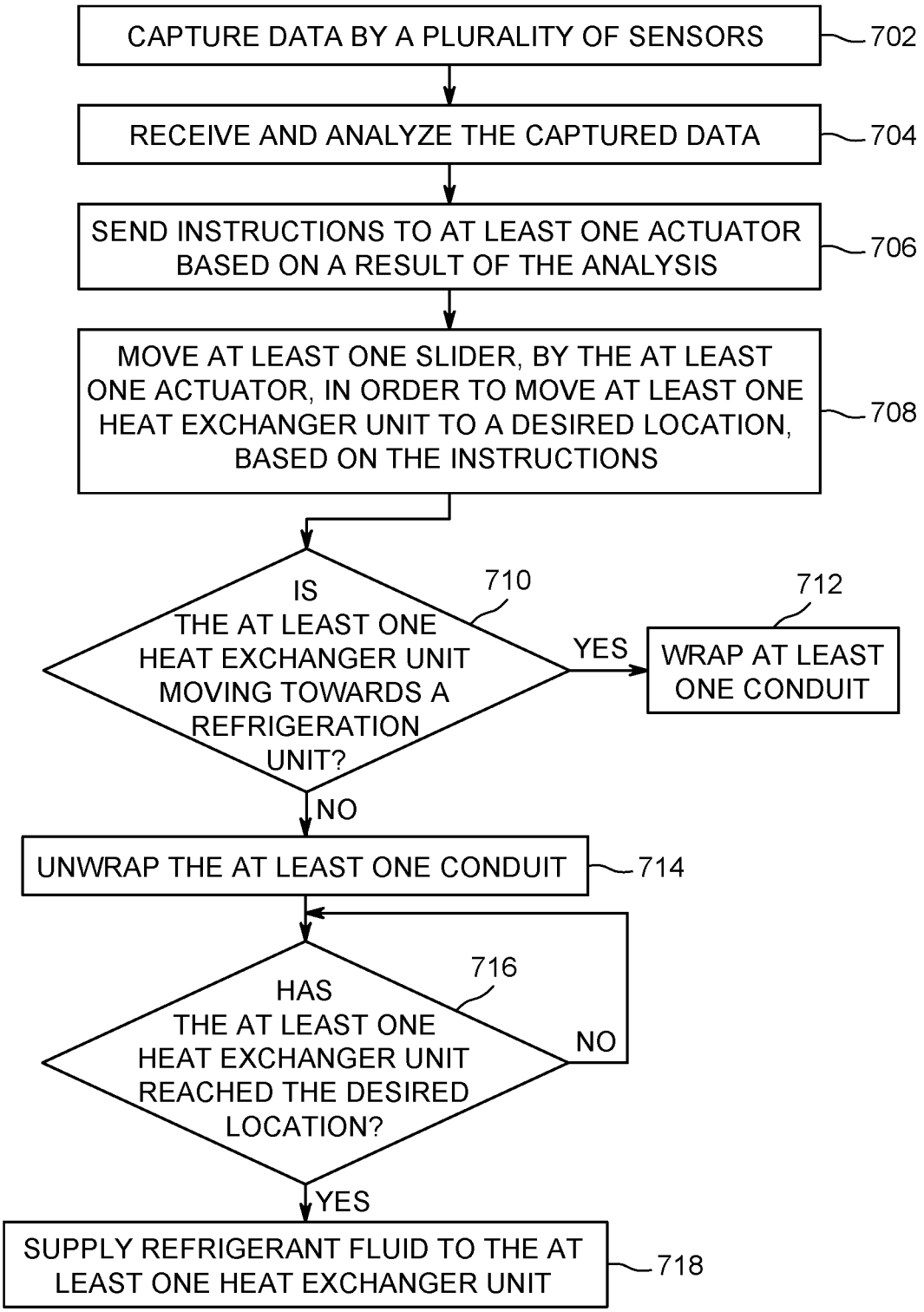
FIG. 7 illustrates a flowchart of a method for operating an HVAC system, in accordance with some embodiments

Referring now to FIG. 7, a flowchart of a method for operating the HVAC system is illustrated, in accordance with some embodiments. At step 702, the plurality of sensors 502 capture data from within the predefined area 102. At step 704, the controller unit 504 receives and analyses the captured data. Based on a result of the analysis, at step 706, the controller unit 504 sends instructions to the one or more actuators 510. At step 708, the one or more actuators 510 move the one or more sliders 512, in order to move the one or more heat exchanger units 514 to a desired location, based on the instructions. At step 710, a check is performed to determine whether the one or more heat exchanger units 514 are moving towards the refrigeration unit 116 or not. If the one or more heat exchanger units 514 are moving towards the refrigeration unit 116, at step 712, the one or more wrapping arrangements start wrapping the one or more conduits to facilitate the movement. However, if the one or more heat exchanger units 514 are moving away from the refrigeration unit 116, at step 714, the one or more wrapping arrangements start unwrapping the one or more conduits to facilitate the movement. At step 716, a check is performed to determine whether the one or more heat exchanger units 514 have reached their respective desired locations. If the one or more heat exchanger units 514 have reached their respective desired locations, the refrigeration unit 116, at step 718, supplies the refrigerant fluid to the one or more heat exchanger units 514. The above discussed steps have been explained in detail in conjunction with FIG. 1 to FIG. 6.

Various embodiments provide an HVAC system that includes multiple heat exchanger units that are movable across an area over a frame. The heat exchanger unit rearrangement enables uniform cooling or heating to the required area. The HVAC system leads to efficient energy management and reduces load on the refrigeration unit. As a result of the reduced energy consumption, the HVAC system has a low carbon footprint. Moreover, the HVAC system enables cost savings by reducing the total number of required heat exchanger units. The HVAC system also enables increased cooling capacity during part load operation. When the HVAC system is installed in a partitioned space, uniform airflow and cooling is maintained throughout the partitioned space. In this case, refrigeration time may also be reduced by locating the heat exchanger units in the same partition. Additionally, the HVAC system is modular as multiple heat exchanger units may be added or removed based on the current requirement.

The illustrated steps are set out to explain the exemplary embodiments shown, and it should be anticipated that ongoing technological development will change the manner in which particular functions are performed. These examples are presented herein for purposes of illustration, and not limitation. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments.

It is intended that the disclosure and examples be considered as exemplary only, with a true scope and spirit of disclosed embodiments being indicated by the following claims.

What is claimed is:

1. A Heating, Ventilation, and Air Conditioning (HVAC) system comprising:

at least one heat exchanger unit disposed within a predefined area; and at least one frame cooperating with each of the at least one heat exchanger unit, wherein the at least one frame comprises a guiding assembly configured to move each of the at least one heat exchanger unit across the predefined area, and wherein the guiding assembly comprises:

a guiding rail enabling movement of the one or more heat exchanger units along the length of one or more of the at least one frame;

at least one slider cooperating with the guiding rail to enable movement of the at least one heat exchanger unit from one position to another position based on load, space, and flow requirements of a plurality of sub-areas within the predefined area, and a location of a plurality of sensors within the plurality of sub-areas, wherein each of the at least one slider comprises a fastening unit including two interlocking parts configured to detachably attach a heat exchanger unit from the at least one heat exchanger unit to an associated slider from the at least one slider, wherein a first interlocking part is affixed to the at least one heat exchanger and a second interlocking part is attached to the at least one slider; and at least one actuator, wherein each of the at least one actuator is configured to move an associated slider from the at least one slider.

2. The HVAC system of claim 1, further comprising a refrigeration unit connected to each of the at least one heat exchanger unit.

3. The HVAC system of claim 2, further comprising at least one winding arrangement comprising at least one conduit configured to connect the at least one heat exchanger unit to the refrigeration unit.

4. The HVAC system of claim 3, wherein each of the at least one conduit is a refrigerant line.

5. The HVAC system of claim 3, wherein a winding arrangement from the at least one winding arrangement is configured to:

wrap an associated conduit from the at least one conduit, when a heat exchanger unit from the at least one heat exchanger unit connected to the associated conduit moves towards the refrigerant unit; and unwrap the associated conduit, when the heat exchanger unit moves away from the refrigerant unit.

6. The HVAC system of claim 1, further comprising the plurality of sensors, wherein data received from the plurality of sensors is used to control movement of the at least one heat exchanger unit.

7. The HVAC system of claim 6, wherein the data received from the plurality of sensors comprises at least one of the load, the flow, the space or temperature data.

8. The HVAC system of claim 1, further comprising a controller configured to activate each of the at least one actuator to move the associated slider.

9. The HVAC system of claim 1, wherein the at least one actuator comprises at least one of a mechanical actuator, a hydraulic actuator, an electrical actuator, a pneumatic actuator, or a magnetic actuator.

10. The HVAC system of claim 1, wherein the predefined area is an enclosed area, wherein the enclosed area comprises at least one partition dividing the enclosed area into the plurality of subareas.

11. A frame for a Heating, Ventilation, and Air Conditioning (HVAC) system comprises:

a guiding assembly configured to move each of at least one heat exchanger unit across a predefined area, wherein the guiding assembly comprises:

a guiding rail enabling movement of the one or more heat exchanger units along the length of one or more of the at least one frame;

at least one slider cooperating with the guiding rail to enable movement of the at least one heat exchanger unit from one position to another position based on load, space, and flow requirements of a plurality of sub-areas within the predefined area, and a location of a plurality of sensors within the plurality of sub-areas, wherein each of the at least one slider comprises a fastening unit including two interlocking parts configured to detachably attach a heat exchanger unit from the at least one heat exchanger unit to an associated slider from the at least one slider, wherein a first interlocking part is affixed to the at least one heat exchanger unit and a second interlocking part is attached to the at least one slider; and at least one actuator, wherein each of the at least one actuator is configured to move an associated slider from the at least one slider.

12. The HVAC system of claim 8, wherein the controller unit is further configured to:

control flow of refrigerant fluid from the refrigeration unit to the at least one heat exchanger unit in response to moving the at least one heat exchanger unit to the location within the sub-area, based on the identified load, space, and flow requirements in the sub-area.

13. The HVAC system of claim 12 further comprising a display unit, wherein the controller is further configured to:

control the display unit to display current operating parameters of the HVAC system, temperature readings at each of the plurality of sub-areas, and a current position of each of the at least one heat exchanger unit in the plurality of sub-areas.

14. The HVAC system of claim 13, wherein the controller is further configured to:

determine that the at least one heat exchanger unit is moving towards the refrigeration unit; and instruct the at least one winding arrangement to start wrapping the at least one conduit to facilitate movement of the at least one heat exchanger unit towards the refrigeration unit.

15. The HVAC system of claim 14, wherein the controller is further configured to:

determine that the at least one heat exchanger unit is moving away from the refrigeration unit; and instruct the at least one winding arrangement to start unwrapping the at least one conduit to facilitate movement of the at least one heat exchanger unit towards the location within the sub-area.

16. The HVAC system of claim 15, wherein the controller is further configured to:

determine whether the at least one heat exchanger unit has reached the location within the sub-area; and control the refrigeration unit to supply the refrigerant fluid to the at least one heat exchanger unit via the at least one conduit, in response to determining that the at least one heat exchanger unit has reached the location within the sub-area.

17. The HVAC system of claim 16, wherein the controller is further configured to:

determine the number of people within each of the plurality sub-areas based on the sensor data received from the plurality of sensors; and identify flow requirements at each of the plurality of sub-areas, based on the number of people determined within each of the plurality of sub-areas.

18. The HVAC system of claim 17, wherein the controller is further configured to:

recognize the face of a person located within a sub-area from the plurality of sub-areas, based the sensor data received from the plurality of sensors; and identify flow requirements in the sub-area based on a customized temperature requirement of the person.

19. The HVAC system of claim 18, wherein the controller is further configured to:

execute an operating program from a plurality of operating programs, wherein the operating program defines various times to move the at least one heat exchanger units to particular locations within the predefined area to attain a desired temperature;

activate the at least one actuator to move the at least one slider and thereby the attached at least one heat exchanger unit to an instructed location based on the operating program, in response to executing the operating program; and activate the at least one actuator to move the at least one slider and thereby the attached at least one heat exchanger unit to a subsequent position instructed in the operating program or to an original position, when the desired temperature is attained at the instructed location.

20. The HVAC system of claim 19, wherein the instruction location within a sub-area corresponds to a central point in the sub-area, and wherein to determine the instructed location, the controller is further configured to:

determine coordinates of the central point in the sub-area, based on the boundary coordinates of the sub-area stored in a layout map of the predefined area.

* * * * *